United States Patent [19]

Benuzzi, deceased et al.

[11] Patent Number: 4,714,395

[45] Date of Patent: Dec. 22, 1987

[54] LIFTING PLATFORM FOR PANELS AND METHOD OF OPERATION THEREOF

[76] Inventors: Gino Benuzzi, deceased, late of Bologna; by Piergiorgio Benuzzi, heir-at-law, 5, Via Angelo Custode, Bologna, both of Italy

[21] Appl. No.: 816,763

[22] Filed: Jan. 7, 1986

[30] Foreign Application Priority Data

Jan. 8, 1985 [IT] Italy ..... 12403 A/85

[51] Int. Cl.[4] ..... B65H 1/14; B65H 5/10

[52] U.S. Cl. ..... 414/114; 271/31; 271/155; 414/119; 414/786

[58] Field of Search ..... 271/130, 148, 31, 128, 271/152, 154, 155; 414/97, 114, 118, 786, 119, 117

[56] References Cited

U.S. PATENT DOCUMENTS

| | | | |
|---|---|---|---|
| 2,437,792 | 3/1948 | Schneider | 271/148 |
| 2,912,243 | 11/1959 | Gulick | 271/31 X |
| 3,410,550 | 11/1968 | Weidman et al. | 271/31 X |
| 3,608,747 | 9/1971 | Shibata et al. | 414/114 |
| 3,716,226 | 2/1973 | Kistner | 271/31 |
| 4,431,358 | 2/1984 | Jenkner | 271/130 X |
| 4,434,912 | 3/1984 | Larson | 414/118 X |
| 4,610,444 | 9/1986 | Land et al. | 271/31 X |

*Primary Examiner*—Robert J. Spar
*Assistant Examiner*—Janice Krizek

[57] ABSTRACT

A lifting platform for feeding stacks of panels to a machining line, in synchronism with the operation of a composite pusher (12) which skims the top side of a stack on the platform, and has transverse beams (5–5') for locally lifting the stack. The pusher has fingers in the same vertical ideal planes as the transverse beams. Above the stack are dimension feelers (14), one for each beam and vertically aligned therewith. At the beginning of each feeding cycle, the lifting platform is in its lowest position, the feelers (14) are completely lowered and the platform is then lifted by a predetermined amount (X) which is detected and evaluated by the feeler(s) first engaging the top of the stack, whereupon the feeler(s) causes the platform to stop. Thereafter, the feelers that had not reached the predetermined dimension are also raised to the same plane by selectively actuating the underlying beams (5–5') which lift the interposed portion of stack by an appropriate amount. After said dimension feelers have been raised, the pusher (12) engages portions of a stack having the same thickness (X).

6 Claims, 10 Drawing Figures

LIFTING PLATFORM FOR PANELS AND METHOD OF OPERATION THEREOF

FIELD OF THE INVENTION

This invention relates to a lifting platform for feeding automatically to any machining line, such as a dividing line, packs of panels which may be of uniform thickness and, for this and/or other reasons, give the stack formed thereby on the lifting platform a wavy or not planar and horizontal top side, and to a method for operating such lifting platform.

BACKGROUND OF THE INVENTION

At present, in order to feed packs of such panels to a working table by means of a pusher whose pushing fingers will skim the top side of the stack horizontally, said top side must be previously prepared manually. The pack of panels to be removed from the top of the stack upon each cycle will be spaced from the remaining lower portion of said stack by introducing wedge-like tools, optionally provided with rollers, into said stack. When the feeding is to be completely automated, a wedge-like member is associated with the transfer member to operate simultaneously, while the portion of stack thereabove is pressed by suitable leveling means. However, this solution has proved suitable only for panels having relatively limited thickness and changes of thickness within relatively strict tolerances. The automated feeding, by means of a pusher, of panels having larger thickness and changes of thickness within broader tolerances is still an unsolved problem.

BRIEF DESCRIPTION OF THE DRAWING

The present invention aims to overcome this problem by a method and a device whose advantages will be apparent from the following description of a preferred embodiment thereof, shown by way of a non-limiting example in the accompanying of draawings, in which.

DESCRIPTION OF THE PREFERRED EMBODIMENT

Figure 1:
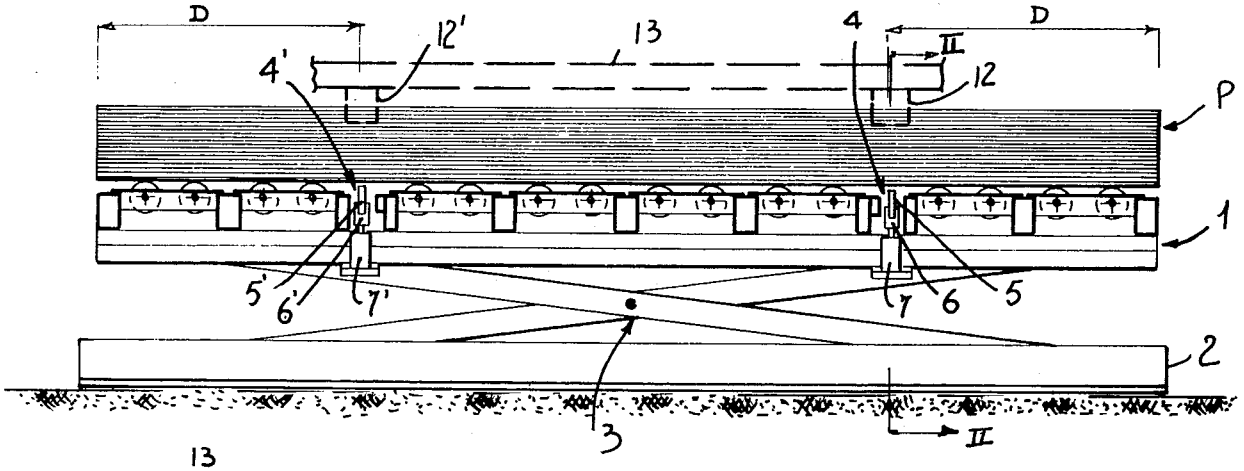
FIG. 1 is a diagrammatic front elevational view of the lifting platform, shown in one of the early steps of its operating cycle.
Figure 2:
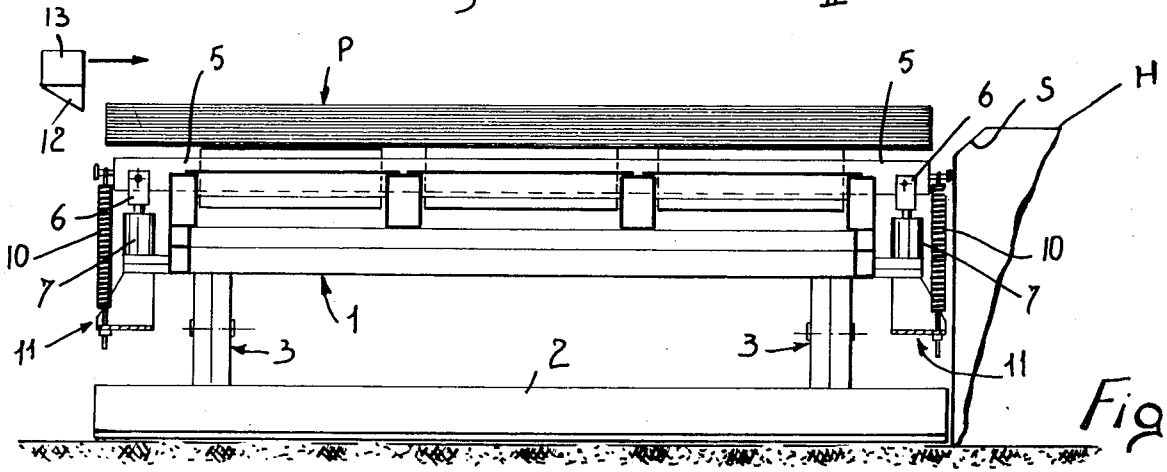
FIG. 2 is a cross sectional view of the lifting platform of FIG. 1, along line II—II, showing further constructional details thereof.
Figure 3:
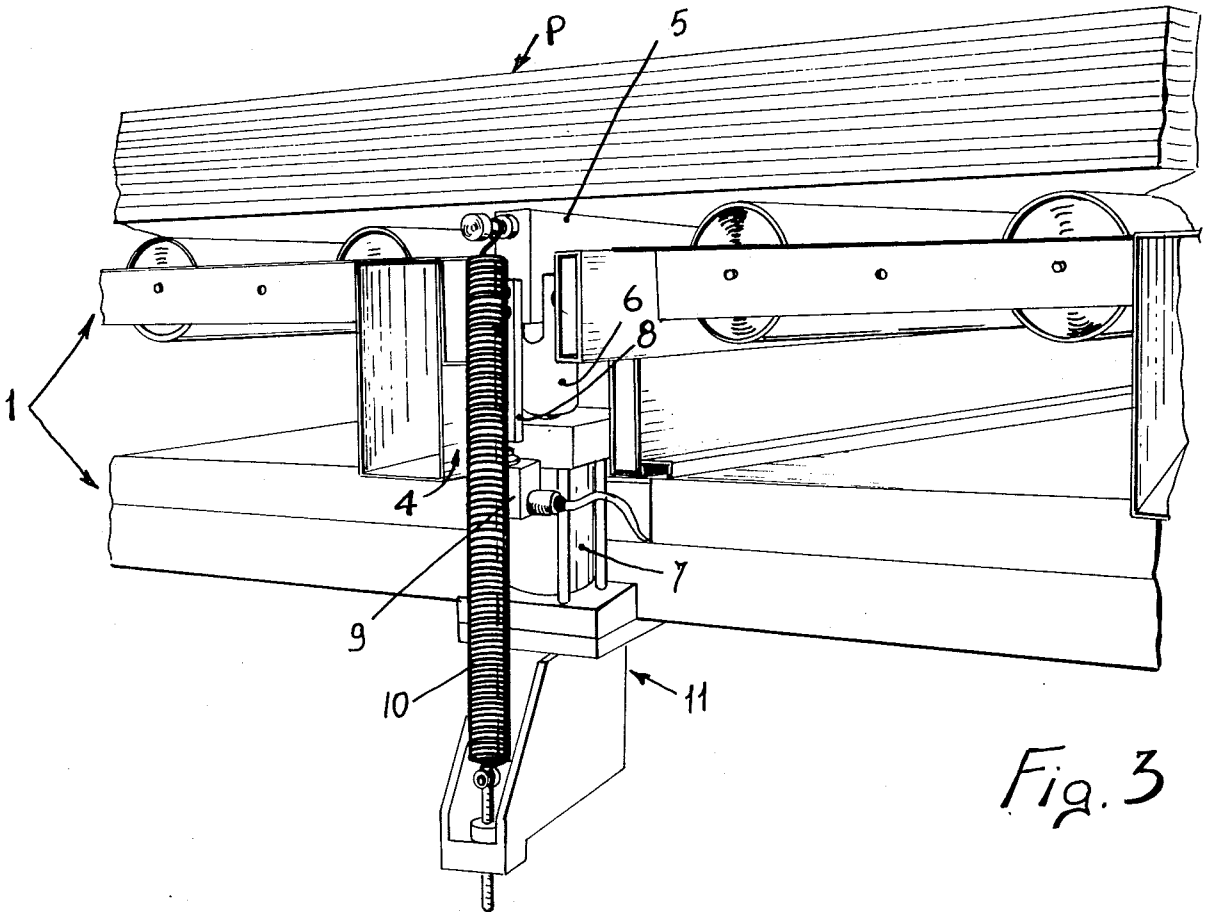
FIG. 3 is a perspective view of one of the end portions of the levelling beams associated with said lifting platform.

With reference to FIGS. 1, 2, 3 and 4, the lifting platform comprises a horizontal loading table 1 provided with rollers or any other conventional means facilitating the positioning thereon of a stack P of panels to be fed as successive packs to a sawing machine, said table 1 being connected in a conventional manner to an underlying structure 2 through the intermediary of conventional means 3 selectively permitting either the lowering or lifting of said table 1 with sufficient accuracy. The lifting platform of the invention differs from conventional platforms in that it comprises, on the table 1, at symmetrical positions, such as at a distance D from the respective ends of said table, which is about ¼ of the entire length of the table, two transverse grooves 4–4′ accommodating respective transverse beams 5–5′ which are located usually below the active surface of said table to avoid interfering with the bottom side of the stack P. As best shown in FIGS. 2 and 3, fork-like members 6–6′ are pivotably connected to the ends of the respective transverse beams 5–5′ and are fixed to the piston rods of two cylinder/piston units 7–7′ which, in turn, are fixed to the peripheral frame of the table 1, through the intermediary of suitable supports, the rods of said units being directed upwards and arranged vertically. The units 7–7′ are connected, through respective solenoid valves, to a control station (not shown), preferably of the hydraulic type, whereby said power units 7–7′ can be actuated selectively. When the transverse beams 5–5′ are in their rest position, suitable extensions 8 secured to each end thereof and directed downwards co-operate with a respective microswitch 9 fixed, for example, to the body of the units 7–7′. A cylindrical coil spring 10 is connected to each end of the transverse beams 5–5′ and to each support 11 to urge said beams towards their lowered rest position. In the FIGS. 1 and 2, the numerals 12, 12′ indicate two pusher fingers the bottom ends of which are in an ideal horizontal plane which is slightly above the horizontal working plane H (at the right in FIG. 2), said pusher being coupled in a conventional manner to a carriage 13 which may be controlled to move horizontally over the stack P with a skimming action thereover to transfer a pack of panels onto said plane H which, as seen in FIG. 2, is formed with a large bevel S at the upper side thereof opposite said platform, to facilitate the access of the pack of panels thereto.

Figure 4:
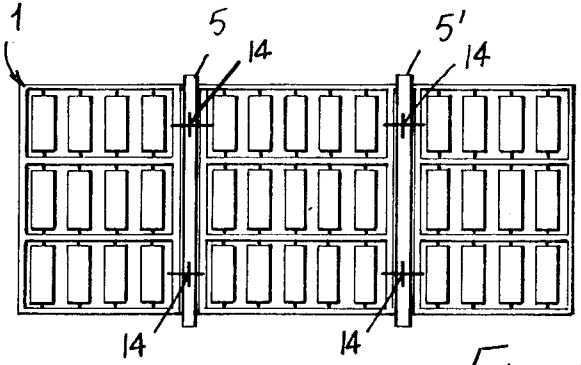
FIG. 4 is a diagrammatic top plan view of the lifting platform.

Four dimension feelers 14 are provided above the stack of panels and are arranged vertically one above each of the ends of the transverse beams 5–5′, as shown diagrammatically in FIG. 4. Each feeler 14 (FIG. 5) comprises a fluid-operated cylinder/piston unit 15 mounted on a support 16 which is fixed to a frame carrying the guides for the carriage 13, said unit 15 being arranged vertically and having its piston rod directed downwards. Also fixed to said support 16, parallel to the unit 15, is a bushing 17 inside which there is mounted a longitudinally slidable rod 18 which, together with the piston rod of the unit 15, is fixed to a support 19. The micro-switches 20–20′ are secured to the support 16 and, alternately, co-operate with projections 21–21′ fixed to the ends of said rod 18, when the feeler is in its upper rest position (FIG. 5) or in its lower operative position (FIG. 6), respectively. Secured to the support 19 is a vertical guide 119 longitudinally slidably receiving a rack 22 that, when said feeler is in a raised condition, abuts with its top enlargement 23 against said guide 119. The rack 22 meshes with a pinion 24 supported by parallel plates 25–25′ which are secured to said guide 119, one end of said pinion having fixed thereto a toothed or punched disc 126 of a photoelectric encoder 26 which is fixed to a side of said guide 119. The encoder 26 is connected to an electronic processor of a type which can be easily conceived by those skilled in the art, wherethrough a function is processed which is proportional to the stroke of the rack 22 within its guide 119.

The feeler comprises, finally, a foot-like member 27 fixed to the lower end of said rack 22.

Figure 8:
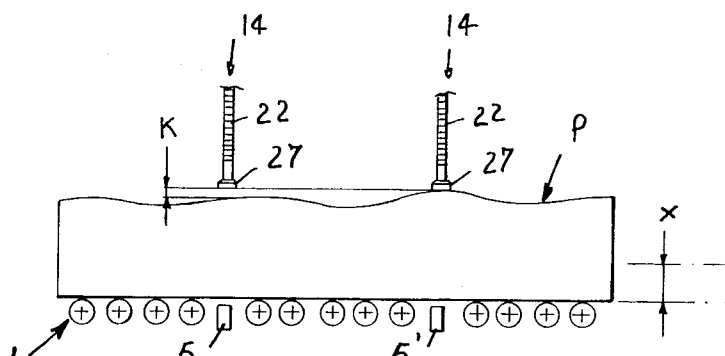
Figures 5, 6, 7:
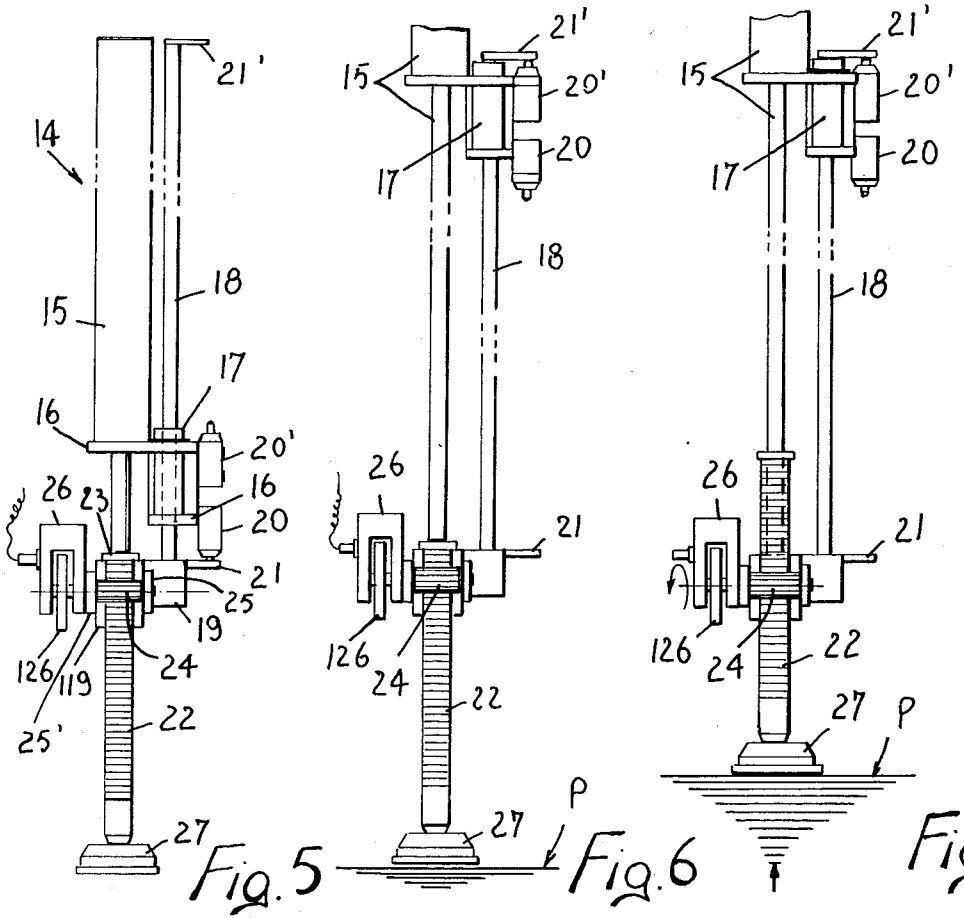
FIGS. 5, 6 and 7 are side elevational views of one of the dimension feelers operatively associated with said lifting platform, said feeler being shown in the rest condition and in two significant steps of its operative cycle, respectively.

The lifting platform described above operates as follows: At the beginning of an operative cycle, said table 1 is in its lower position, so that the top of the stack P is below the horizontal ideal plane containing the bottom ends of said pushing fingers 12, now in their rest position. The feelers 14 are in their raised position as shown in FIG. 5 and the transverse beams 5–5' are in their lowered position as shown in FIGS. 1–2 and 3. In the first step of the operating cycle of the platform, the four feelers 14 will all be lowered, as seen in FIG. 6, so that each feeler will actuate the respective limit microswitch 20'. On completion of this stroke, the foot-like members 27 of said feelers all reach the horizontal ideal plane containing the bottom ends of the pushing fingers 12, and said foot-like members will not engage said stack P. Due to distortions of the top side of the stack P, the portions thereof below said foot-like members 27 of the feelers may not be located on a single plane, i.e., a certain difference of level may exist therebetween, said difference of level being indicated, for example, for two such points of the stack, at K in FIG. 8.

Figure 9:
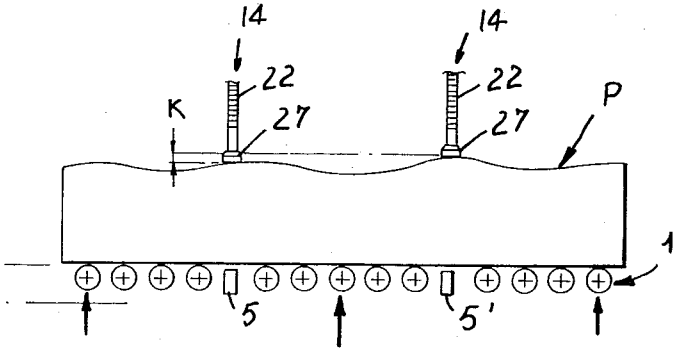
FIGS. 8, 9 and 10 are diagrammatic front elevational views of the lifting platform during three significant steps of its operative cycle.
Figure 10:
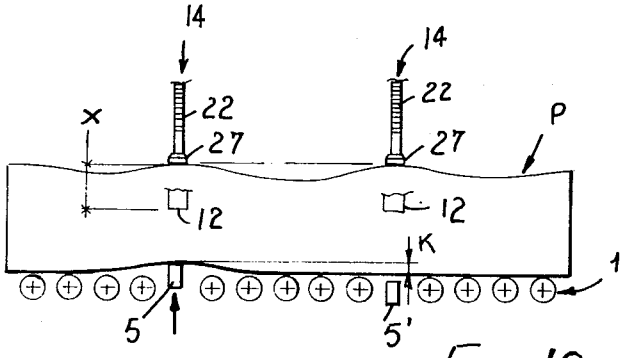

The successive operating step of the platform comprises the lifting up of the table 1 and, therefore, of the stack P, by an amount which is indicated at X in FIG. 9, said amount being the same as the thickness of the pack of panels that are to be transferred onto the working plane H, said amount being stored in the memory of said control processor and being computed by the encoder, or encoders, 26, of the feeler or feelers 14 which for first have engaged the top side of the stack P with their foot-like members 27. The lifting of said stack causes the lifting of the rack 22 and, therefore, the rotation of the pinion 24 and disc 126, said rotation being converted by the encoder 26 into a function which is proportional to the extent of the lifting of said rack, said function being then transferred to said processor wherein the previously mentioned function (X) is stored as the level to which the highest point of the top side of the stack is to be moved from the ideal horizontal plane containing the bottom ends of the pushing fingers 12. After the table 1 has been lifted up, due to the imperfect planarity of the top side of the stack P, the foot-like members 27 of some feelers 14 will maintain the level difference K (FIG. 9) mentioned above by way of example. Upon such occurrence, again with an automatic succession of steps, according to the invention, the foot-like members 27 that are located at a level below the other foot-like member(s) that caused the interruption of the lifting stroke of the table 1, will be raised to become co-planar with said higher foot-like members by means of an appropriate lifting movement of the corresponding end of the appropriate transverse beams 5–5', i.e., by activating the appropriate jacks 7–7', as clearly shown in FIG. 10. After this action, the level difference K existing previously between the foot-like members 27 of the dimension feelers 14 is transferred to the lower portion of the stack, between the ends of the transverse beams 5, 5', and the four top areas of said stack that are contacted by said feelers are perfectly co-planar with one another. Following this step, the feelers 14 will all be lifted as shown in FIG. 5. It is now apparent that, when the carriage 13 with its pushing fingers 12 is actuated to effect its working stroke, said fingers 12 can transfer towards and onto the plane H a suitably arranged pack of panels, because said fingers will engage portions of a stack P which have the same thickness X. On completion of the working stroke of the carriage 13, the transverse beams 5–5' move back to their low or rest position and the carriage 13 also moves back to its rest position, ready to repeat the cycle described above.

In the above description, we have omitted the constructional details of the carriage 13 and pusher 12 associated therewith, and the details of the various electrical circuits and of the fluid-operated systems as well as of the various safety and control devices, because they are obvious to those skilled in the art.

What is claimed is:

1. A method for the automatic operation of a lifting platform for feeding packs of panels to a machining line, in which a top surface of a stack of panels formed on said lifting platform is not perfectly even and horizontal but presents an undulated configuration, said platform cooperating with a carriage provided with a plurality of co-planar pushers which are actuated to skim horizontally over the top of said stack of panels to transfer a pack of predetermined height (X) onto an adjoining horizontal working table, said method comprising the steps of (a) lowering a plurality of dimension feelers to a horizontal plane containing bottom ends of said pushers;

(b) lifting the platform above said horizontal plane containing said bottom ends of said pushers by an amount (X) equal to the thickness of the pack of panels to be transferred onto the working table, with consequent differentiated lifting of said dimension feelers depending upon the actual thickness of said pack of panels in correspondence of each feeler, the different amounts of lifting of individual feelers being input to a computer through transducer means;

(c) lifting of a plurality of lifters arranged in vertical alignment with said dimension feelers, and acting from below on said stack of panels formed on said platform, individually and selectively under the control of said compouter, by such differentiated amounts that all dimension feelers which contact the respective portions of said top surface of said stack of panels, are lifted to a common horizontal level; and (d) lifting said dimension feelers clear of said top surface of said stack of panels, and actuating said pushers to transfer said pack of panels of predetermined height (X) onto said working table.

2. A method according to claim 1, wherein the amount (X) is equal to the distance of upward movement of that dimension feeler which first contacts said top surface of said stack of panels.

3. A lifting platform for feeding packs of panels to a machining line, said platform cooperating with a carriage provided with a plurality of co-planar pushes which are actuated to skim horizontally over the top of a stack of panels built up on a loading table of said platform, to transfer a pack of predetermined height (X) onto an adjoining horizontal working table, comprising:

(a) a plurality of lifters having a localized action, arranged within recesses formed in the loading table, said lifters being vertically movable between a lowered rest position below the supporting surface defined by the top surface of the loading table and a lifted position above the said supporting surface, said lifters being arranged in the same vertical planes as said pushers and being liftable individually and selectively by controlled amounts by lifting units;

(b) a plurality of dimension feelers supported by a stationary structure above the lifting platform for contacting the top surface of said stack of panels, said dimension feelers being arranged vertically in line with each of said lifters, said dimension feelers being vertically movable between an upper inoperative position and a lower working position in which the said feelers reach the same horizontal level of the co-planar pushers;

(c) computer-controlled actuation means operating in response to the vertical movement of the dimension feelers, following upward movement of the loading table to bring a pack of predetermined height (X) with its lowermost panel in alignment with the surface of the working table, said actuation means selectively effecting the actuation of the lifting units for the lifting of the lifters.

4. A lifting platform according to claim 3, wherein said lifters for locally lifting the stack of panels comprise at least two transverse beams accommodated within respective recesses formed in the loading table of said platform, said beams being connected to respective hydraulic lifting jacks the body of which is fixed to a frame of said loading table, said beams being urged toward their rest position by suitable means such as springs, sensors being provided to detect said rest position.

5. A lifting platform according to claim 4, wherein said dimension feelers are four in number, one in line with each end of said underlying lifting beams, so that planarity is ensured both at the side of the stack which is facing said pushers and at the opposite side where the stack is adjacent the working table onto which said packs of panels are to be fed.

6. A lifting platform according to claim 5, wherein said dimension feelers each comprise a rack-and-pinion unit, wherein a guide carrying a rack portion of said rack-and-pinion unit is arranged vertically, rotatably supports a pinion portion of said unit and supports as well an encoder having a toothed or punched disc fixed to said pinion portion, said rack portion being provided at the bottom end thereof with a foot-like member and being provided at the top end thereof with a stop member to abut against the top side of its guide, the latter being associated with vertically moving means controlled by sensors which detect when said unit is in its upper, inoperative position or in its lower, working position, the arrangement being such that when the four feelers are lowered onto the stack which is in a lower position, said foot-like members of said feelers are disposed in the same horizontal plane containing the bottom ends of said pushers, the arrangement being such that the vertical movement imposed on the rack portions of said feelers due to the upward movement of said table and to the subsequent engagement with the top surface of the stack, is converted into a corresponding rotation of the disc of said encoder, which will transmit an electric function, proportional to said vertical movement to said computer-controlled actuation means of the lifting units.

* * * * *